US012649213B2

(12) United States Patent
Jang et al.

(10) Patent No.: US 12,649,213 B2
(45) Date of Patent: Jun. 9, 2026

(54) SUBSTRATE POLISHING APPARATUS

(71) Applicant: SAMSUNG ELECTRONICS CO., LTD., Suwon-si (KR)

(72) Inventors: Myungjae Jang, Suwon-si (KR); Donghoon Kwon, Suwon-si (KR); Jonghyuk Park, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 546 days.

(21) Appl. No.: 18/196,178

(22) Filed: May 11, 2023

(65) Prior Publication Data

US 2024/0165769 A1 May 23, 2024

(30) Foreign Application Priority Data

Nov. 22, 2022 (KR) ..... 10-2022-0156950

(51) Int. Cl.
*B24B 57/02* (2006.01)
*B24B 37/04* (2012.01)

(52) U.S. Cl.
CPC ..... *B24B 57/02* (2013.01); *B24B 37/04* (2013.01)

(58) Field of Classification Search
CPC ..... B03C 1/02; B24B 37/04; B24B 37/042; B24B 37/044; B24B 57/02
See application file for complete search history.

(56) References Cited

U.S. PATENT DOCUMENTS 6,238,279 B1 * 5/2001 Shau ..... B24B 37/04 451/60
6,291,350 B1 9/2001 Hashimoto et al.
6,352,469 B1 * 3/2002 Miyazaki ..... B24B 37/04 451/910
6,585,570 B2 * 7/2003 Kim ..... B24B 1/04 451/36
8,387,902 B2 3/2013 Gotou
10,286,522 B2 * 5/2019 Inui ..... B24B 57/02
10,562,150 B2 2/2020 Yamanaka
12,138,741 B2 * 11/2024 Sun ..... B24B 55/12

FOREIGN PATENT DOCUMENTS

| | | | |
|---|---|---|---|
| CN | 212824289 | U | 3/2021 |
| KR | 452618 | A | 5/2003 |
| KR | 20070108685 | A | 11/2007 |
| KR | 20100040056 | A | 4/2010 |
| KR | 2127563 | A | 12/2019 |

* cited by examiner

*Primary Examiner* — Michael Leslie
(74) *Attorney, Agent, or Firm* — Fish & Richardson P.C.

(57) ABSTRACT

A substrate polishing apparatus includes; a platen including an upper surface configured to perform a polishing process on a semiconductor substrate, a slurry supply configured to supply slurry to the upper surface of the platen, wherein the slurry includes aqueous solution and abrasive particles, a collection pipe disposed under the platen and configured to guide the slurry, wherein the collection pipe includes a vertical guide pipe and a lateral guide pipe, a collection device disposed on an outer surface of the collection pipe, wherein the collection device includes an alternating arrangement of magnetic separators configured to separate the abrasive particles from the slurry using an electromagnetic force and sonicators configured to decompose the abrasive particles, and a collection tank connected to the collection pipe and configured to store the abrasive particles separated from the slurry by the collection device.

20 Claims, 5 Drawing Sheets

SUBSTRATE POLISHING APPARATUS

CROSS REFERENCE TO RELATED APPLICATION

This application claims priority under 35 U.S.C. § 119 to Korean Patent Application No. 10-2022-0156950 filed on Nov. 22, 2022 in the Korean Intellectual Property Office, the subject matter of which is hereby incorporated by reference in its entirety.

BACKGROUND

1. Field

Embodiments of the inventive concept relate to substrate polishing apparatuses. More particularly, embodiments of the inventive concept relate to substrate polishing apparatuses using a slurry to perform a polishing process on a semiconductor substrate.

2. Description of the Related Art

During a chemical mechanical polishing (CMP) process slurry may be applied between the surface of a semiconductor substrate being polished and a rotating platen. Following use during the polishing process, the slurry may flow into a collection tank. Recycling slurry allows reduction in the cost of manufacturing semiconductor devices. For example, an aqueous solution may be separated from abrasive agents in order to form a fluorite substitute.

SUMMARY

Embodiments of the inventive concept provide substrate polishing apparatuses capable of recycling the aqueous solution and reducing overall manufacturing costs associated with the fluorite substitute;

In some embodiments of the inventive concept, a substrate polishing apparatus may include; a platen including an upper surface configured to perform a polishing process on a semiconductor substrate, a slurry supply configured to supply slurry to the upper surface of the platen, wherein the slurry includes aqueous solution and abrasive particles including a paramagnetic material, a collection pipe disposed under the platen and configured to guide the slurry, wherein the collection pipe includes a vertical guide pipe and a lateral guide pipe, a collection device disposed on an outer surface of the collection pipe, wherein the collection device includes an alternating arrangement of magnetic separators configured to separate the abrasive particles from the slurry using an electromagnetic force and sonicators configured to decompose the abrasive particles, and a collection tank connected to the collection pipe and configured to store the abrasive particles separated from the slurry by the collection device.

In some embodiments of the inventive concept, a substrate polishing apparatus may include; a platen including an upper surface configured to perform a polishing process on a semiconductor substrate, a slurry supply configured to supply slurry onto the upper surface of the platen, wherein the slurry includes aqueous solution and abrasive particles, a collection pipe configured to guide the slurry, wherein the collection pipe includes a vertical guide pipe and a lateral guide pipe, a collection structure disposed below the platen and including a first opening connected to the collection pipe, a collection device disposed an outer surface of the vertical guide pipe, wherein the collection device includes an alternating arrangement of magnetic separators configured to separate the abrasive particles from the slurry using an electromagnetic force and sonicators configured to decompose the abrasive particles, a collection tank disposed under the vertical guide pipe and configured to store the abrasive particles separated from the slurry by the collection device, and an aqueous solution tank connected to the lateral guide pipe and configured to store the aqueous solution separated from the slurry.

In some embodiments of the inventive concept, a substrate polishing apparatus may include; a platen including an upper surface configured to perform a polishing process on a semiconductor substrate, a slurry supply configured to supply slurry onto the upper surface of the platen, wherein the slurry includes aqueous solution and abrasive particles, a collection pipe configured to guide the slurry, wherein the collection pipe includes a vertical guide pipe and a lateral guide pipe, a collection structure disposed below the platen and including a first opening connected to the collection pipe, a collection device disposed an outer surface of the lateral guide pipe, wherein the collection device includes an alternating arrangement of magnetic separators configured to separate the abrasive particles from the slurry using an electromagnetic force and sonicators configured to decompose the abrasive particles, a collection tank disposed under the lateral guide pipe and configured to store the abrasive particles separated from the slurry by the collection device, and an aqueous solution tank connected to the lateral guide pipe and configured to store the aqueous solution separated from the slurry.

BRIEF DESCRIPTION OF THE DRAWINGS

Advantages, benefits and features, as well as the making and use of the inventive concept may be clearly understood upon consideration of the following detailed description together with the accompanying drawings, in which.

DETAILED DESCRIPTION

Throughout the written description and drawings, like reference numbers and labels are used to denote like or similar elements, components, features and/or method steps. Throughout the written description certain geometric terms may be used to highlight relative relationships between elements, components and/or features with respect to certain embodiments of the inventive concept. Those skilled in the art will recognize that such geometric terms are relative in nature, arbitrary in descriptive relationship(s) and/or directed to aspect(s) of the illustrated embodiments. Geometric terms may include, for example: height/width; vertical/horizontal; top/bottom; higher/lower; closer/farther;

thicker/thinner; proximate/distant; above/below; under/over; upper/lower; center/side; surrounding; overlay/underlay; etc.

Figure 1:
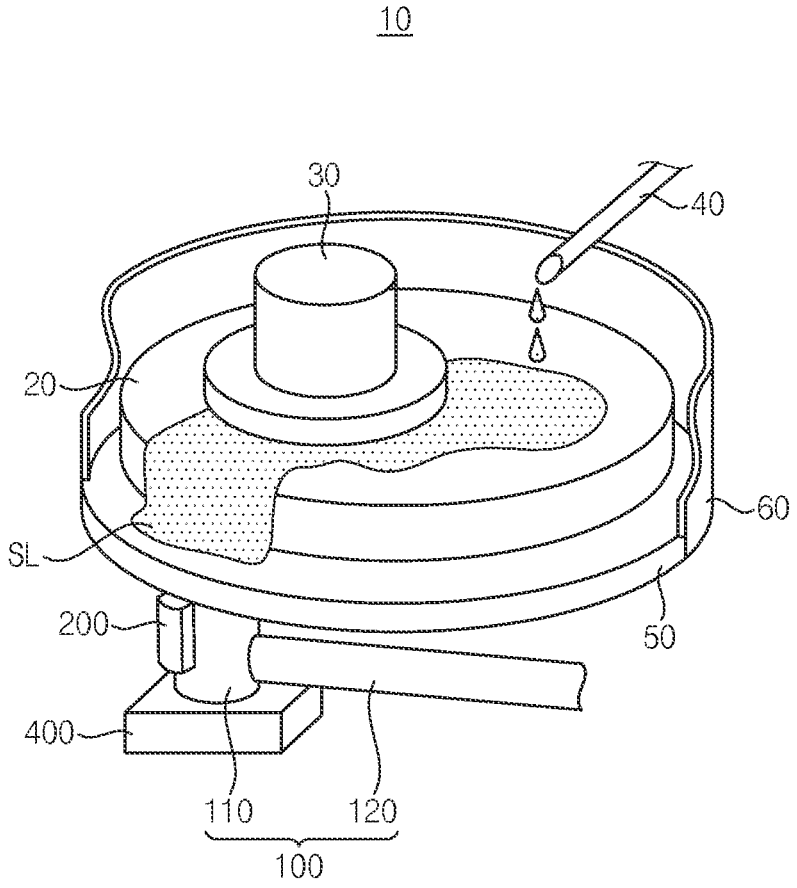
FIG. 1 is a perspective view illustrating a substrate polishing apparatus according to embodiments of the inventive concept.
Figure 2:
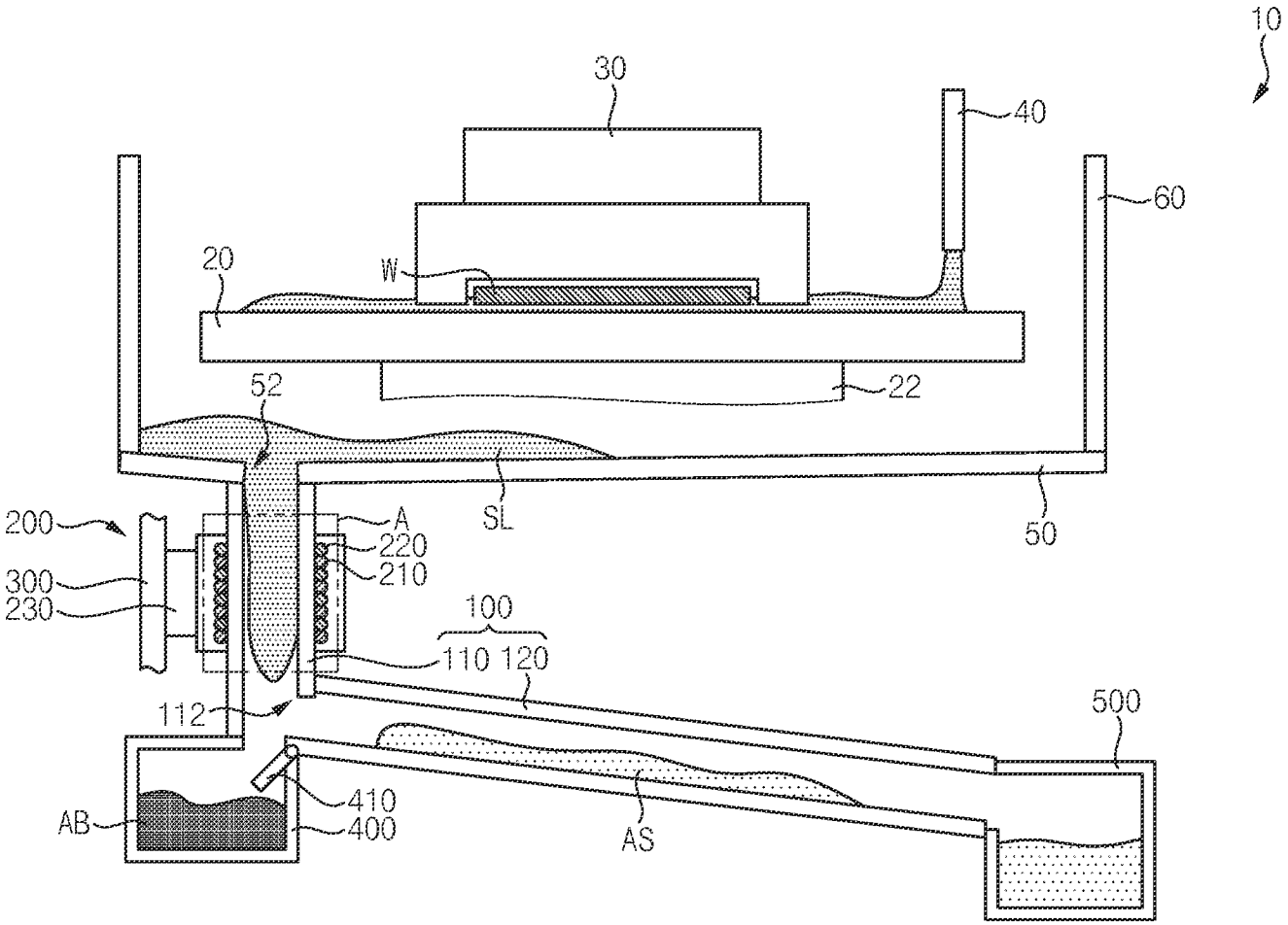
FIG. 2 is a cross-sectional view further illustrating the substrate polishing apparatus of FIG. 1.
Figure 3:
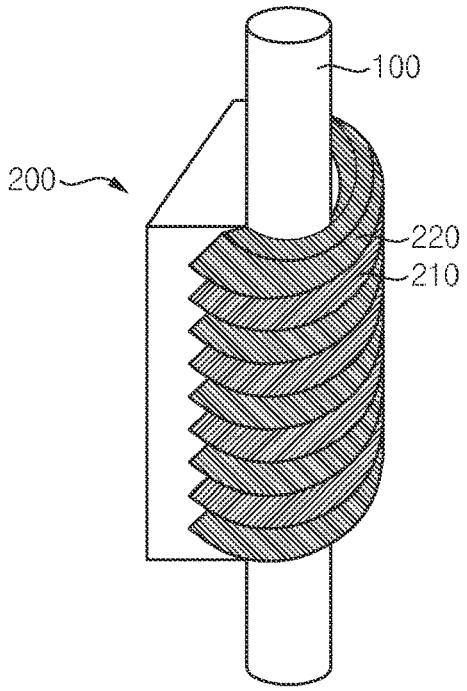
FIG. 3 is a perspective view further illustrating the collection device 200 of FIG. 2.
Figure 4:
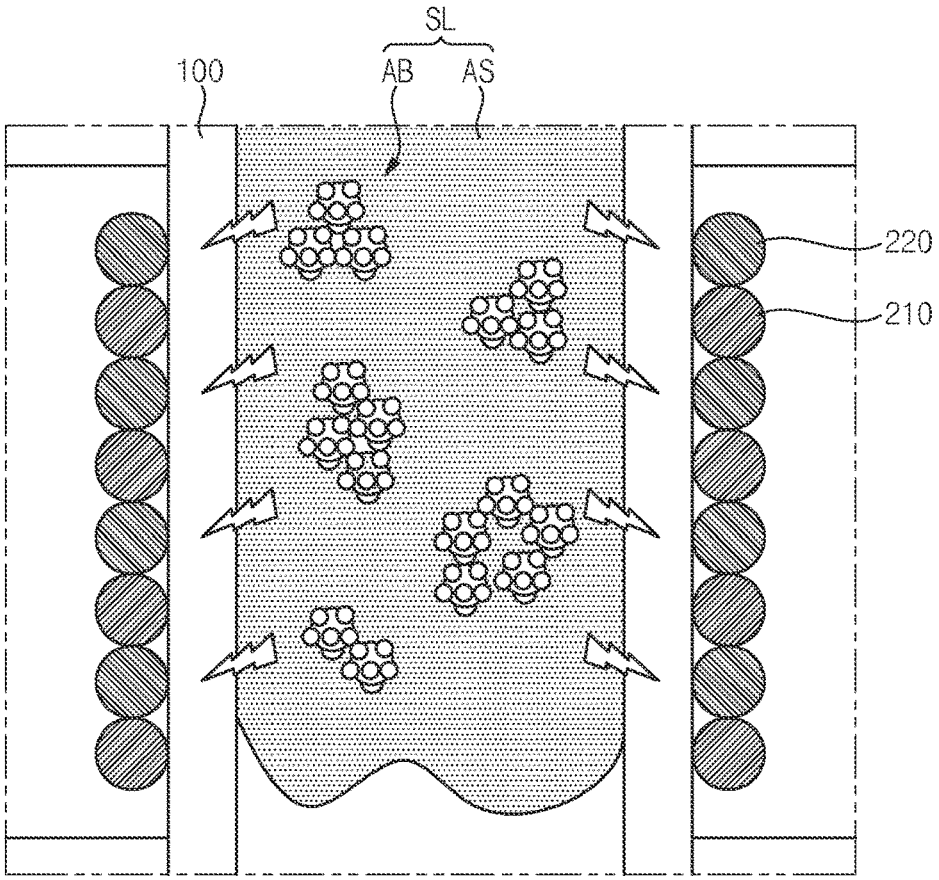
FIGS. 4 and 5 are respective conceptual views further illustrating the region 'A' indicated in FIG. 2.
Figure 5:
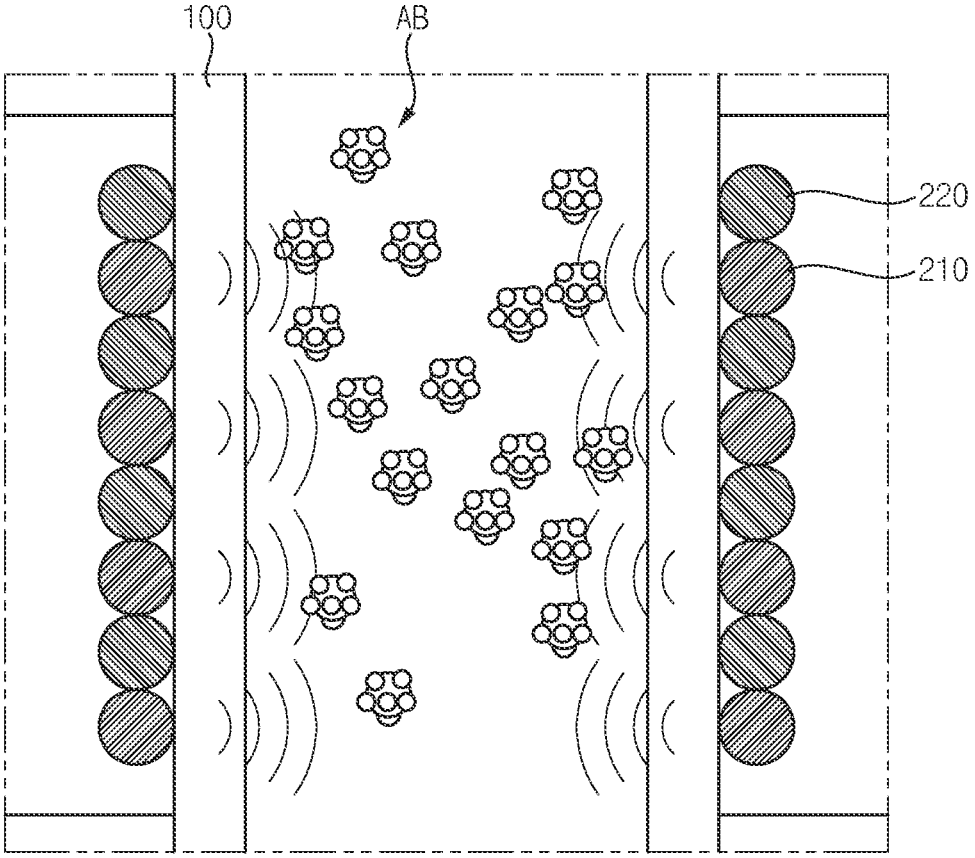

FIG. 1 is a perspective view illustrating a substrate polishing apparatus according to embodiments of the inventive concept; FIG. 2 is a cross-sectional view further illustrating the substrate polishing apparatus of FIG. 1; FIG. 3 is a perspective view further illustrating the collection device 200 of FIG. 2; and FIGS. 4 and 5 are respective conceptual views further illustrating the region 'A' indicated in FIG. 2 during the process of purifying slurry.

Referring collectively to FIGS. 1, 2, 3, 4 and 5, a substrate polishing apparatus 10 may include a platen 20 and a substrate holder 30, wherein a semiconductor substrate W may be attached to a downward facing surface of the substrate holder 30. That is, the substrate holder 30 may be variously configured to "fix" (e.g., mechanically force and release) the semiconductor substrate W against the platen 20. The substrate polishing apparatus 10 may also include a slurry supply 40 configured to supply a slurry (SL) onto the platen 20, a collection pipe 100 configured to collect the slurry associated with a polishing process applied to the semiconductor substrate W, a collection device 200 configured to separate the slurry into (1) an aqueous solution and (2) abrasive particles, and a collection tank 400 configured to collect the separated abrasive particles.

In some semiconductor processes, the substrate polishing apparatus 10 may be understood as an apparatus capable of selectively removing at least a portion of the downwardly facing surface of the semiconductor substrate W. In some embodiments, the substrate polishing apparatus 10 may be used to facilitate various grinding processes collectively referred to as chemical mechanical polishing (CMP) processes. For example, the substrate polishing apparatus 10 may be used to polish the semiconductor substrate W to a desired thickness. Here, in some embodiments, the semiconductor substrate W may be a wafer.

In some embodiments, the upper surface of the platen 20 may be placed into contact with the lower surface of the semiconductor substrate W during a polishing process. The platen 20 may be supported on a shaft 22 capable of rotating (e.g., clockwise or counterclockwise) the platen 20 at a desired speed. Thus, during the polishing process the platen 20 spins as the semiconductor substrate W is brought into contact with the upper surface of the platen 20.

In this manner the lower surface of the semiconductor substrate W is polished (or frictionally abraded) by contact with the upper surface of the platen 20. In some embodiments, the upper surface of the platen 20 may have a roughness defined by a topography of fine concavo-convex structures, wherein the roughness of the upper surface of the platen 20 may be determined so as to efficiently polish the lower surface of the semiconductor substrate W.

The platen 20 may rotate in response to a rotational force applied by the shaft 22, and while rotating, the slurry is uniformly spread across the upper surface of the platen 20 by the applied rotational (or centrifugal) force. The platen 20 may generate frictional force against which the semiconductor substrate W may be pressed. That is, the platen 20 may generate a frictional force between the semiconductor substrate W and the slurry in response to the rotational force. In some embodiments, the upper surface of the platen 20 may include one or more abrasive material(s), such as for example, glass, quartz, fused silica, and sapphire.

In some embodiments, the substrate holder 30 may include a detachable grip allowing the semiconductor substrate W to be transported and manually fixed against the platen 20. In this regard, the substrate holder 30 may be used to move the semiconductor substrate W horizontally across the upper surface of the platen 20 and/or vertically press semiconductor substrate W against the platen 30. Here, the pressing of the semiconductor substrate W against the upper surface of the platen 20 increases the frictional force between the semiconductor substrate and the platen 20 through the slurry. In some embodiments, the platen 20 and the substrate holder 30 may rotate in opposite directions to further increase the frictional force.

In some embodiments, the slurry supply 40 may supply the slurry onto the platen 20, such that the slurry migrates between the semiconductor substrate W and the platen 20. In this regard, the slurry may be uniformly distributed across the upper surface of the platen 20 by the rotational force.

In some embodiments, the slurry may include a combination of aqueous solution (AS) (e.g., an aqueous phase aqueous solution, an acidic aqueous phase aqueous solution, etc.) having a defined fluidity and one or more abrasive particles (AB) suspended in the aqueous solution. The slurry may be purified in the collection device 200 while passing through the collection pipe 100.

Particular abrasive particles may be selected to freely move within the aqueous solution, and may include certain abrasive particles (e.g., formed from paramagnetic material(s)) exhibiting magnetic properties in response to applied magnetic field. Thus, in some embodiments, abrasive particles may be obtained by mixing one or more substrate abrasive(s) (e.g., cesium oxide ($CeO_2$), silicon dioxide ($SiO_2$), etc.) with one or more paramagnetic material(s). For example, the abrasive particles may include divalent iron oxide ($Fe_2O_3$), trivalent iron oxide ($Fe_3O_4$), divalent iron oxide cesium oxide mixture ($Fe_2O_3$, $CeO_2$), trivalent iron oxide cesium oxide mixture ($Fe_3O_4$, $CeO_2$), divalent iron oxide silicon dioxide mixture ($Fe_2O_3$, $SiO_2$), and trivalent iron oxide silicon dioxide mixtures ($Fe_3O_4$, $SiO_2$).

The slurry may further include a booster selected to increase polishing strength by adhering to a polishing film of the semiconductor substrate W. Alternately or additionally, the slurry may include an inhibitor selected to reduce polishing strength by adhering to the polishing film of the semiconductor substrate W. Here, the choice of booster and/or inhibitor varies with several factors including material composition of the polishing film of the semiconductor substrate W.

In some embodiments, the substrate polishing apparatus 10 may further include a collection structure 50 and a shielding wall 60. The collection structure 50 may be disposed below the platen 20 and may include a first opening 52 that guides slurry running off (e.g., flowing under the influence of gravity) the platen 20 into the collection pipe 100. In functional effect, the collection structure 50 directs the slurry associated with a polishing process into the first opening 52. In some embodiments, the collection structure 50 may include a funneling structure directing the slurry through the first opening 52 and into the collection pipe 100.

The shielding wall 60 may vertically extend from a periphery of the collection structure 50 to capture any slurry that is splashed or sprayed from the platen 20 or the slurry supply 40. Thus, in some embodiments, the vertical height of the shielding wall 60 may rise above the level of the upper surface of the platen 20. In this manner, the shielding wall 60 serves to guide slurry onto the collection structure 50.

In some embodiments, the collection pipe 100 may guide the slurry through a purification process (e.g., a process that separates abrasive particles from the slurry). That is, the collection pipe 100 may drains slurry from the collection structure 50 through a vertical guide pipe 110 connected to the collection structure 50 and through a lateral guide pipe 120 extending from the vertical guide pipe 110. In this regard, however, the particular arrangement of vertical guide pipe 110 and lateral guide pipe 120 shown in FIG. 2 is just one example of many possible piping arrangements that may be used to implement the collection pipe 100 according to embodiments of the inventive concept. For example, the collection pipe 100 may include additional pipes capable of facilitating the purification process for slurry associated with a polishing process.

A first (or upper) end of the vertical guide pipe 110 may be connected to the first opening 52 of the collection structure 50 and a second (or lower) end (e.g., a lower opening 112) of the vertical guide pipe 110 may be connected to the lateral pipe 120. The second end of the vertical guide pipe 110 may also be connected to an abrasive particle collection tank 400 configured to store the abrasive particles (AB) separated from the slurry. With this configuration, the vertical guide pipe 110 may direct slurry through the lower opening 112 and into the lateral guide pipe 120. In particular, the vertical guide pipe 110 may guide the aqueous solution of the slurry into the lateral guide pipe 120 through the lower opening 112.

Accordingly, a first end of the lateral guide pipe 120 may be connected to the lower opening 112 of the vertical guide pipe 110 and a second end of the lateral guide pipe 120 may be connected to an aqueous solution tank 500 configured to store the aqueous solution separated from the slurry. In some embodiments, the lateral guide pipe 120 may disposed with an incline sufficient to effectively guide the aqueous solution into the aqueous solution tank 500 under the influence of gravity.

In some embodiments, the collection device 200 may be used to purify the slurry passing through the collection pipe 100. That is, the collection device 200 may be used to separate abrasive particles from the aqueous solution largely making up the slurry. In some embodiments, the collection device 200 may include one or more magnetic separators 210 and/or one or more sonicators 220, wherein the magnetic separators 210 separate the abrasive particles from the aqueous solution using an electromagnetic force and the sonicators 220 then decompose the abrasive particles.

In some embodiments, the collection device 200 may be disposed on an outer wall of the collection pipe 100 (e.g., on an outer surface of the vertical guide pipe 110). Within this configuration, the collection device 200 may separate the slurry passing through the vertical guide pipe 110 into aqueous solution and abrasive particles. In this regard, the collection device 200 may include a first moving mechanism 230 vertically traversing the outer surface of the vertical guide pipe 110 and vertically moving the collection device 200 along the vertical guide pipe 110. Further in this regard, the vertical movement of the first moving mechanism 230 allows the collection device 200 to purify the slurry over a relatively greater area.

Here, it should be noted that the collection device 200 may be variously configured in relation to the vertical guide pipe 110. For example, the collection device 200 may move on the outer surface of the vertical guide pipe 110 by operation of first moving mechanism 230.

The magnetic separators 210 may inhibit the passage of abrasive particles through the vertical guide pipe 110. That is, the magnetic separators 210 may generate an electromagnetic force across the vertical guide pipe 110 through the outer surface of the vertical guide pipe 110. Accordingly, a magnetic field may be formed in the vertical guide pipe 110 under the influence of this electromagnetic force. Abrasive particles including paramagnetic material (e.g., a material exhibiting a magnetic property) respond to the magnetic field incited by the magnetic separators 210, thereby inhibiting the movement of abrasive particles including paramagnetic material through the vertical guide pipe 110. It follows that since substrate abrasives contemplated by embodiments of the inventive concept include paramagnetic material, such substrate abrasive will react to the magnetic force together with the paramagnetic material.

The sonicators 220 may be used to decompose abrasive particles separated from the slurry as it passes through the vertical guide pipe 110 together with the aqueous solution. In some embodiments, the sonicators 220 may generate and apply ultrasonic waves to the vertical guide pipe 110 through its outer surface. Accordingly, mechanical vibrations will be induced in the vertical guide pipe 110 under the influence of the applied ultrasonic waves, thereby decomposing the mixture structure of the abrasive particles.

In some embodiments like the one shown in FIG. 3, the magnetic separators 210 and the sonicators 220 may be alternately arranged along at least a portion of the outer surface of the collection pipe 100. When the magnetic separators 210 and the sonicators 220 are alternately arranged, the magnetic separators 210 may generate the magnetic field across an area taken along a longitudinal direction of the collection pipe 100, and the sonicators 220 may generate ultrasonic waves across substantially the same area of the collection pipe 100. Thus, the abrasive particles may be inhibited (or captured) by the magnetic field along a substantial length of the collection pipe 100 and the mixture structure of the abrasive particles may be decomposed.

In some embodiments an alternating multiplicity of magnetic separators 210 and sonicators 220 may cover a length of the outer surface of the collection pipe 100. When the magnetic separators 210 and the sonicators 220 surround the outer surface of the collection pipe 100, the magnetic separators 210 will generate the magnetic field in a wide area along a circumferential direction of the collection pipe 100, and the sonicators 220 will generate ultrasonic waves in the wide area along the circumferential direction of the collection pipe 100. Accordingly, abrasive particles may be captured by the magnetic field in the wide area, the mixture structure of the abrasive particles may be decomposed.

As further illustrated in FIG. 4, when slurry passes through the collection pipe 100, the magnetic separators 210 may be used to separate abrasive particles from the aqueous solution using an electromagnetic force. In some embodiments, the magnetic separators 210 and the sonicators 220 operate in an alternating (ON/OFF) manner. Since the magnetic separators 210 inhibits (or halts) the abrasive particles using the electromagnetic force when the operation of the sonicators 220 is stopped, abrasive particles are influenced by only the electromagnetic force and may be more strongly inhibited by the magnetic separators 210.

As the magnetic separators 210 capture abrasive particles using the applied electromagnetic force, the aqueous solution continues to pass through the collection pipe 100 under the influence of gravity. Accordingly, the slurry may be effectively separated into aqueous solution and abrasive particles in a continuous manner within the collection pipe 100.

As illustrated in FIG. 5, abrasive particles remaining in the collection pipe 100 are subjected to the sonicators 220 which decompose the mixture structure of the abrasive particles through the application of ultrasonic waves. When the sonicators 220 operate, the magnetic separators 210 may stop operating. Since the sonicators 220 decompose the mixture structures of the abrasive particles through the application of ultrasonic wave while operation of the magnetic separators 210 is stopped, the mixture structures receive only mechanical vibrations corresponding to the ultrasonic waves and may be more efficiently decomposed.

In a state wherein abrasive particles are substantially separated from the aqueous solution, the sonicators 220 may effectively decompose the mixture structures through the application of ultrasonic waves. And in a state wherein abrasive particles are substantially separated from the aqueous solution, the abrasive particles may not have material viscosity. Accordingly, the mixture structures of the abrasive particles may be readily decomposed.

Referring to FIG. 2, in some embodiments, the substrate polishing apparatus 10 may further include guide rails that extend along the collection pipe 100. The guide rails may include a first guide rail 300 extending vertically along the vertical guide pipe 110. In some embodiments, the first guide rail 300 may be combined with the first moving mechanism 230 of the collection device 200. The first guide rail 300 may limit a movement path of the collection device 200, such that the collection device 200 stably moves on the outer surface of the vertical guide pipe 110.

The first guide rail 300 may guide the magnetic separators 210 and the sonicators 220 as they traverse the outer surface of the vertical guide pipe 110. The first moving mechanism 230 may move the magnetic separators 210 and the sonicators 220 along the first guide rail 300 in the vertical direction. Since the first moving mechanism 230 moves in the vertical direction, the magnetic separators 210 and the sonicators 220 may purify the slurry over a relatively wide area.

The collection tank 400 may be variously connected to the vertical guide pipe 110, and may be used to collect abrasive particles moving along the vertical guide pipe 110. In this manner, abrasive particles moving along the vertical guide pipe 110 by the gravity may be introduced into the collection tank 400. The collection tank 400 may also be variously connected to the vertical guide pipe 110 as noted above. Thus, the collection tank 400 may collect abrasive particles that move along the vertical guide pipe 110. In this manner, abrasive particles moving along the vertical guide pipe 110 may be introduced into the collection tank 400.

In some embodiments, the collection tank 400 may further include a door (or cover) 410 configured to pass abrasive particles into the collection tank 400 while blocking the aqueous solution. That is, as the aqueous solution moves through the collection pipe 100, the door 410 may be positioned to block entrance into the collection tank 400, and the closed door 410 may guide the aqueous solution from the vertical guide pipe 110 to the lateral guide pipe 120. However, when abrasive particles pass through the collection pipe 100, the open door 410 may allow entry into the collection tank 400. In this manner, the door 410 may selectively pass only abrasive particles into the collection tank 400.

In some embodiments, the substrate polishing apparatus 10 may further include the aqueous solution tank 500 provided under the collection pipe 100. The aqueous solution tank 500 may be connected to one end of the lateral guide pipe 120 to collect aqueous solution traversing along the lateral guide pipe 120. Here, the purified aqueous solution stored in the aqueous solution tank 500 may have a relatively high purity, given the absence of separated-out abrasive particles. The aqueous solution stored in the aqueous solution tank 500 may therefore be recycled into manufacturing operations that use slurry.

As described above, the slurry associated with a polishing process may be separated into an aqueous solution and abrasive particles by operation of the collection device 200. The magnetic separators 210 may be used to separate abrasive particles including at least one paramagnetic material from the aqueous solution. The sonicators 220 may decompose the mixture structure of the abrasive particles through the application of ultrasonic waves. Since the magnetic separators 210 and the sonicators 220 are alternately arranged along an outer surface of the collection pipe 100, the collection device 200 may efficiently separate abrasive particles from the aqueous solution.

Also, since the collection device 200 moves along the outer surface of the collection pipe 100 through the guide rail that extends along the collection pipe 100, the collection device 200 may separate abrasive particles from the aqueous solution along a relatively wide area. And since abrasive particles and aqueous solution are separated in the collection pipe 100, overall manufacturing cost (e.g., those associated with the formation of a fluorite substitute from the slurry) may be reduced.

Figure 6:
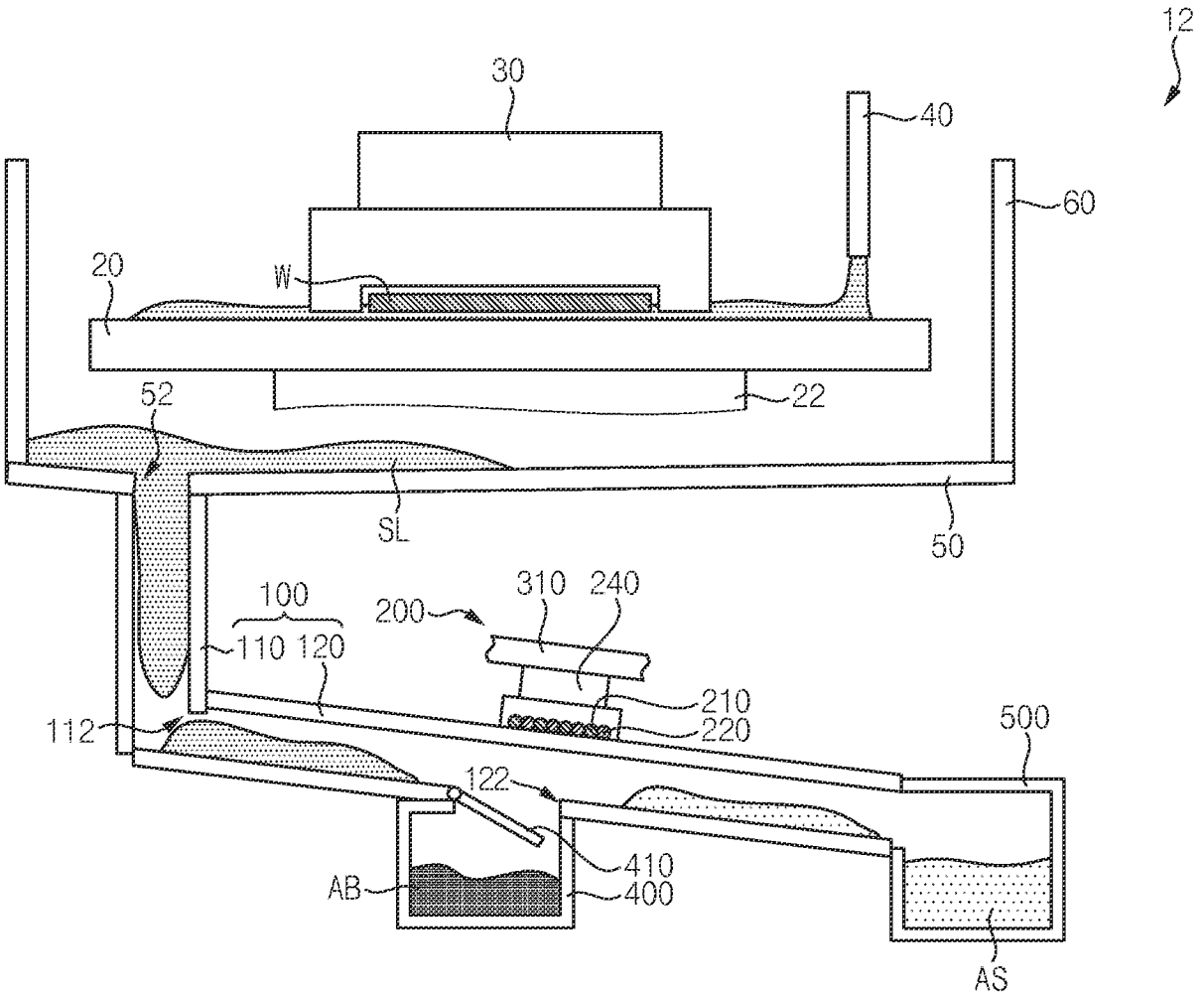
FIG. 6 is a cross-sectional view illustrating a substrate polishing apparatus according to embodiments of the inventive concept.

FIG. 6 is a cross-sectional view illustrating a substrate polishing apparatus 12 that according to another embodiment of the inventive concept. Here, substrate polishing apparatus 12 may be compared with the substrate polishing apparatus 10 of FIG. 1, wherein the a collection device is disposed in relation to the lateral guide pipe 120 instead of the vertical guide pipe 110. Otherwise the substrate polishing apparatus 12 of FIG. 6 is substantially similar to the substrate polishing apparatus 10 previously described in relation to FIGS. 1, 2, 3, 4, and 5.

Referring to FIG. 6, the substrate polishing apparatus 12 includes; the platen 20; the substrate holder 30 supporting the semiconductor substrate W; the slurry supply 40; the collection pipe 100; the collection device 200, and the collection tank 400.

Here again, the collection device 200 may be disposed along an outer wall of the collection pipe 100, but instead of being functionally associated with the vertical guide pipe 110, the collection device 200 is functionally associated with the lateral guide pipe 120. That is, the collection device 200 may separate the slurry passing through the lateral guide pipe 120 into aqueous solution and abrasive particles.

The collection device 200 may further include a second moving mechanism 240 that moves on the outer surface of the lateral guide pipe 120. The second moving mechanism 240 may move the magnetic separators 210 and the sonicators 220 in a substantially lateral direction along the lateral guide pipe 120. Since the second moving mechanism 240 moves along a substantially lateral direction, the magnetic separators 210 and the sonicators 220 may purify the slurry over a relatively wide area.

For example, the collection device 200 may be fixed on the outer surface of the lateral guide pipe 120. Alternatively, the collection device 200 may move on the outer surface of the lateral guide pipe 120 through the second moving mechanism 240.

As before, the magnetic separators 210 may inhibit the movement of abrasive particles within the slurry passing through the lateral guide pipe 120, and the sonicators 220 may decompose the abrasive particles in the slurry passing through the lateral guide pipe 120.

In some embodiments, the substrate polishing apparatus 12 may include the guide rails extending along the collection pipe 100. The guide rail may include a second guide rail 310 extending along the lateral guide pipe 120. The second guide rail 310 may be combined with the second moving mechanism 240 of the collection device 200. The second guide rail 310 may limit the movement path of the collection device 200 such that the collection device 200 may stably move on the outer surface of the lateral guide pipe 120.

In some embodiments, the collection tank 400 may be used to store abrasive particles separated from the aqueous solution passing through the collection device 200. The collection tank 400 may be provided under the collection pipe 100. The collection tank 400 may be provided to be connected to a third opening 122 of the lateral guide pipe 120 that is not connected to the collection device 200.

The collection tank 400 may collect the abrasive particles that move along the lateral guide pipe 120. The abrasive particles moving along the lateral guide pipe 120 by the gravity may be introduced into the collection tank 400.

The magnetic separators 210 of the collection device 200 may temporarily stop the abrasive particles through the electromagnetic force. When the electromagnetic force of the magnetic separators 210 is removed, the abrasive particles may fall into the collection tank 400 through the third opening 122 by the gravity.

When the aqueous solution moves into the collection pipe 100, the door 410 may block the collection tank 400. The door 410 may guide the aqueous solution to the aqueous solution tank 500 within the lateral guide pipe 120.

Thus, the slurry used during a polishing process may be separated into aqueous solution and abrasive particles using a collection device according to embodiments of the inventive concept. The magnetic separators may separate the abrasive particles having a paramagnetic material from the aqueous solution. The sonicators may decompose a mixture structure of the abrasive particles through ultrasonic waves. Since the magnetic separators and the sonicators are alternately arranged on the outer surface of the collection pipe, the collection device may efficiently separate the abrasive particles and the aqueous solution.

Also, since the collection device moves along the outer surface of the collection pipe through a guide rail that extends along the collection pipe, the collection device may separate the abrasive particles and the aqueous solution from a wide area. Since the abrasive particles and the aqueous solution are separated into the collection pipe, manufacturing cost for forming fluorite substitute from the slurry may be reduced.

The foregoing embodiments are provided by way of teaching example. Although a few example embodiments have been described, those skilled in the art will readily appreciate that many modifications are possible in example embodiments without materially departing from the novel teachings and advantages of the inventive concept. Accordingly, all such modifications are intended to fall within the scope of inventive concept, as defined by the following claims.

What is claimed is:

1. A substrate polishing apparatus, comprising:

a platen including an upper surface configured to perform a polishing process on a semiconductor substrate;

a slurry supply configured to supply slurry to the upper surface of the platen, wherein the slurry includes aqueous solution and abrasive particles including a paramagnetic material;

a collection pipe disposed under the platen and configured to guide the slurry, wherein the collection pipe includes a vertical guide pipe and a lateral guide pipe;

a collection device disposed on an outer surface of the collection pipe, wherein the collection device includes an alternating arrangement of magnetic separators configured to separate the abrasive particles from the slurry using an electromagnetic force and sonicators configured to decompose the abrasive particles; and a collection tank connected to the collection pipe and configured to store the abrasive particles separated from the slurry by the collection device.

2. The substrate polishing apparatus of claim 1, further comprising:

a first guide rail extending along the vertical guide pipe, wherein the collection device further includes a first moving mechanism configured to move the magnetic separators and the sonicators along the vertical guide pipe on the first guide rail.

3. The substrate polishing apparatus of claim 1, further comprising:

a second guide rail extending along the lateral guide pipe, wherein the collection device further includes a second moving mechanism configured to move the magnetic separators and the sonicators along the lateral guide pipe on the second guide rail.

4. The substrate polishing apparatus of claim 1, wherein the collection device is disposed on the vertical guide pipe, and the collection tank is connected below the vertical guide pipe.

5. The substrate polishing apparatus of claim 1, wherein the collection device is disposed on the lateral guide pipe, and the collection tank is disposed under the lateral guide pipe opposite to the collection device.

6. The substrate polishing apparatus of claim 1, wherein the magnetic separators and the sonicators are disposed directly on the outer surface of the collection pipe.

7. The substrate polishing apparatus of claim 1, wherein the collection tank includes a door configured to pass the abrasive particles and block the aqueous solution.

8. The substrate polishing apparatus of claim 1, wherein the magnetic separators and the sonicators alternately operate as the slurry passes through the collection pipe.

9. The substrate polishing apparatus of claim 1, wherein the abrasive particles include at least one of divalent iron oxide ($Fe_2O_3$), trivalent iron oxide ($Fe_3O_4$), divalent iron oxide cesium oxide mixture ($Fe_2O_3$, $CeO_2$), trivalent iron oxide cesium oxide mixture ($Fe_3O_4$, $CeO_2$), divalent iron oxide silicon dioxide mixture ($Fe_2O_3$, $SiO_2$), and trivalent iron oxide silicon dioxide mixtures ($Fe_3O_4$, $SiO_2$).

10. A substrate polishing apparatus, comprising:

a platen including an upper surface configured to perform a polishing process on a semiconductor substrate;

a slurry supply configured to supply slurry onto the upper surface of the platen, wherein the slurry includes aqueous solution and abrasive particles;

a collection pipe configured to guide the slurry, wherein the collection pipe includes a vertical guide pipe and a lateral guide pipe;

a collection structure disposed below the platen and including a first opening connected to the collection pipe;

a collection device disposed an outer surface of the vertical guide pipe, wherein the collection device includes an alternating arrangement of magnetic separators configured to separate the abrasive particles from the slurry using an electromagnetic force and sonicators configured to decompose the abrasive particles;

a collection tank disposed under the vertical guide pipe and configured to store the abrasive particles separated from the slurry by the collection device; and an aqueous solution tank connected to the lateral guide pipe and configured to store the aqueous solution separated from the slurry.

11. The substrate polishing apparatus of claim 10, further comprising:

a first guide rail extending along the vertical guide pipe, wherein the collection device further includes a first moving mechanism configured to move the magnetic separators and the sonicators along the vertical guide pipe on the first guide rail.

12. The substrate polishing apparatus of claim 10, wherein the collection device is fixed on the vertical guide pipe, and the collection tank is connected to a lower end of the vertical guide pipe.

13. The substrate polishing apparatus of claim 10, wherein the collection tank includes a door configured to pass abrasive particles and block the aqueous solution.

14. The substrate polishing apparatus of claim 10, wherein the magnetic separators and the sonicators alternating operate as slurry passes through the vertical guide pipe.

15. The substrate polishing apparatus of claim 10, wherein the abrasive particles include at least one of divalent iron oxide ($Fe_2O_3$), trivalent iron oxide ($Fe_3O_4$), divalent iron oxide cesium oxide mixture ($Fe_2O_3$, $CeO_2$), trivalent iron oxide cesium oxide mixture ($Fe_3O_4$, $CeO_2$), divalent iron oxide silicon dioxide mixture ($Fe_2O_3$, $SiO_2$), and trivalent iron oxide silicon dioxide mixtures ($Fe_3O_4$, $SiO_2$).

16. A substrate polishing apparatus, comprising:

a platen including an upper surface configured to perform a polishing process on a semiconductor substrate;

a slurry supply configured to supply slurry onto the upper surface of the platen, wherein the slurry includes aqueous solution and abrasive particles;

a collection pipe configured to guide the slurry, wherein the collection pipe includes a vertical guide pipe and a lateral guide pipe;

a collection structure disposed below the platen and including a first opening connected to the collection pipe;

a collection device disposed an outer surface of the lateral guide pipe, wherein the collection device includes an alternating arrangement of magnetic separators configured to separate the abrasive particles from the slurry using an electromagnetic force and sonicators configured to decompose the abrasive particles;

a collection tank disposed under the lateral guide pipe and configured to store the abrasive particles separated from the slurry by the collection device; and an aqueous solution tank connected to the lateral guide pipe and configured to store the aqueous solution separated from the slurry.

17. The substrate polishing apparatus of claim 16, further comprising:

a second guide rail extending along the lateral guide pipe, wherein the collection device further includes a second moving mechanism configured to move the magnetic separators and the sonicators along the lateral guide pipe on the second guide rail.

18. The substrate polishing apparatus of claim 16, wherein the collection device is fixed on the outer surface of the lateral guide pipe, and the collection tank is disposed under the collection device opposite the collection device.

19. The substrate polishing apparatus of claim 16, wherein the magnetic separators and the sonicators alternating operate as slurry passes through the lateral guide pipe.

20. The substrate polishing apparatus of claim 16, wherein the abrasive particles include at least one of divalent iron oxide ($Fe_2O_3$), trivalent iron oxide ($Fe_3O_4$), divalent iron oxide cesium oxide mixture ($Fe_2O_3$, $CeO_2$), trivalent iron oxide cesium oxide mixture ($Fe_3O_4$, $CeO_2$), divalent iron oxide silicon dioxide mixture ($Fe_2O_3$, $SiO_2$), and trivalent iron oxide silicon dioxide mixtures ($Fe_3O_4$, $SiO_2$).

* * * * *